United States Patent [19]

Åkesson

[11] Patent Number: 4,590,742

[45] Date of Patent: May 27, 1986

[54] METHOD AND MACHINE FOR PACKING A ROPE INTO A CONTAINER

[76] Inventor: Stig H. Åkesson, Örenäs, Västanväg, S-237 00 Bjärred, Sweden

[21] Appl. No.: 463,866

[22] PCT Filed: May 28, 1982

[86] PCT No.: PCT/SE82/00191

§ 371 Date: Jan. 21, 1983

§ 102(e) Date: Jan. 21, 1983

[87] PCT Pub. No.: WO82/04239

PCT Pub. Date: Dec. 9, 1982

[30] Foreign Application Priority Data

May 29, 1981 [SE] Sweden ..... 8103394

[51] Int. Cl.[4] ..... B65H 54/76

[52] U.S. Cl. ..... 53/430; 28/289; 53/116; 226/168; 242/82; 242/83

[58] Field of Search ..... 53/430, 116, 118, 522, 53/581, 255; 242/82, 83; 226/168, 190; 28/289

[56] References Cited

U.S. PATENT DOCUMENTS

| | | | |
|---|---|---|---|
| 444,652 | 1/1891 | Roberts | 242/82 |
| 911,297 | 2/1909 | Dawson | 53/116 |
| 2,936,509 | 5/1960 | Martin | 53/116 |
| 2,981,494 | 4/1961 | Kovaleski | 242/83 |
| 3,234,627 | 2/1966 | Russo et al. | 28/289 |
| 3,316,609 | 5/1967 | Russo | 28/289 |
| 3,780,963 | 12/1973 | Hirschfelder | 242/82 |
| 4,080,772 | 3/1978 | Chambley et al. | 242/82 |
| 4,153,212 | 5/1979 | Bauch et al. | 242/82 |

*Primary Examiner*—Francis S. Husar
*Assistant Examiner*—Jerry Kearns
*Attorney, Agent, or Firm*—Shapiro and Shapiro

[57] ABSTRACT

A rope (21) is packed into a container (31) in such a manner as to permit easy extraction therefrom in that the rope by means of a winding head (25) is coiled with the coil center situated between the center line and periphery of the container (31). For this purpose a rope supply reel (20) is mounted on a supporting device (15) which is rotatable about a fixed vertical shaft (30). The rope (21) is pulled from the reel (20) down into the container (31) by means of the winding head (25) which is connected to the supporting device (15) for rotation with it. The winding head (25) is arranged in the space between the center line and periphery of the container, and means (30, 34–42) are provided to rotate the container (31) about its axis and at the same time axially displace the container so that layer after layer of line coils are placed upon each other.

9 Claims, 3 Drawing Figures

METHOD AND MACHINE FOR PACKING A ROPE INTO A CONTAINER

This invention relates to a method of packing a rope into a container in such a manner as to permit easy extraction of the rope therefrom, in which method the rope is withdrawn from a supply reel and led down into the container to be coiled therein with the coil centre situated between the centre line and periphery of the container, while the container is rotated and a simultaneous relative axial movement is effected between a winding head and the container.

Survival equipments comprise a container with a rope which is intended for extraction by means of a rocket. For this reason it is of extreme importance that the rope runs out with the least possible resistance. This naturally places great demands on the packing of the rope, which at present is made entirely by hand and thus of course implies high packing costs. The reason why packing is carried out by hand simply is that hitherto no machine has been available, which is capable of performing this work with the desired reliability.

The object of the present invention is to pack such a rope in a novel manner so that all safety requirements are satisfied at the same time as the packing of the rope can be carried out mechanically. This object is attained in that the rope is withdrawn from the supply reel by means of the rotating winding head and discharged from the head for coiling and is rotated or twisted about its longitudinal axis on its way down into the container.

The invention also relates to a machine for packing a rope of this kind, said machine being characterised in that it comprises a frame with a shaft fixed at its upper end and extending a predetermined distance vertically downward, a supporting device rotatably mounted on the shaft and having a rope reel rotatably mounted thereon, a support means for the container for supporting it such that its centre line extends parallel to but laterally spaced from the fixed shaft, whereby said shaft projects into the container with its axis situated in the space between the centre line and periphery of the container, a rotary winding head on the free end of the fixed shaft projecting into the container, said winding head being adapted, upon rotation, to withdraw the rope from the rope reel during the rotation of the reel supporting device and to coil the rope with the coil centre situated between the centre line and periphery of the container, and means for rotating the rope reel supporting device, the winding head and the support means with the container and simultaneously axially moving the support means vertically downward.

Figure 1:
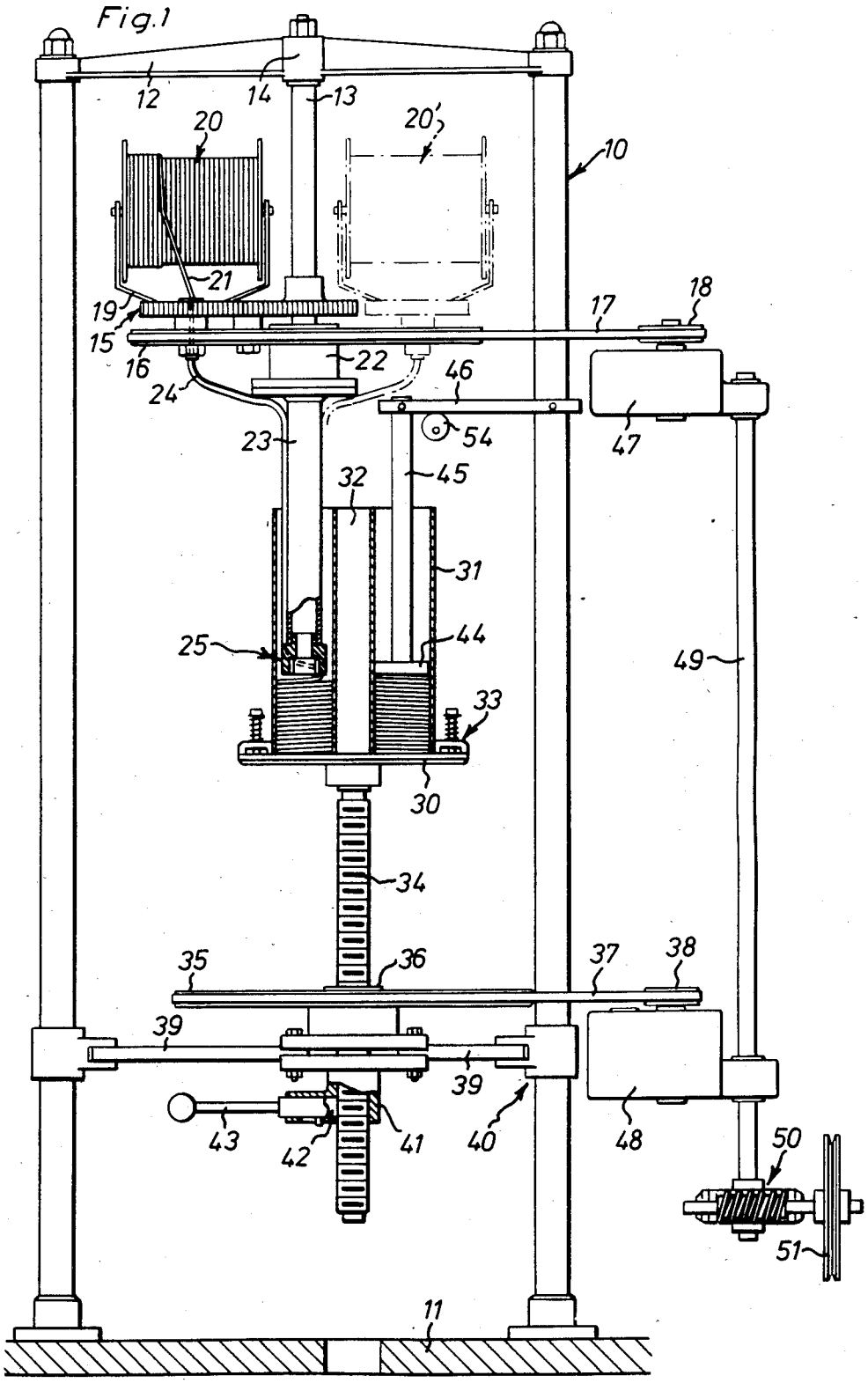

The invention will be more fully described below with reference to the accompanying drawings in which:

FIG. 1 in elevation shows an embodiment of the invention; and

Figure 2:
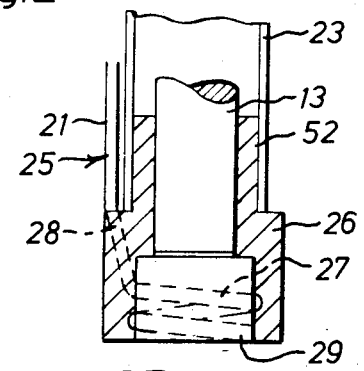
Figure 3:
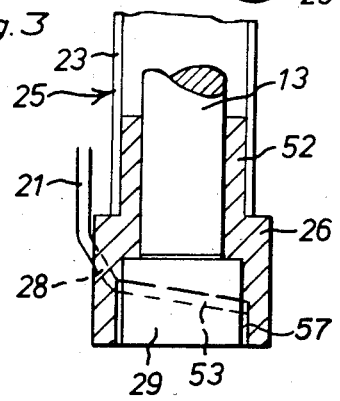

FIGS. 2 and 3 on a larger scale show a winding head in section and from below.

According to FIG. 1 a machine according to the invention has a frame 10 which is fixed to a bottom plate 11. At the top the frame has a transverse beam 12 in the centre of which a vertical shaft 13 is secured by means of a fastening device 14. The shaft 13 extends vertically downward and a supporting device generally designated 15 is rotatably mounted at a distance from the transverse beam 12. The supporting device 15 has a drive pulley 16 which is coaxial with the shaft 13 and about which a V-belt 17 is passed. The V-belt 17 is driven by a drive pulley 18. Secured to the supporting device 15 is a holder 19 for rotary accommodation of a rope supply reel 20 onto which is wound a rope 21. The supporting device 15 at the underside of the V-belt pulley 16 has a fastening 22 with which a tubular sleeve 23 is rigidly connected via flange means. The sleeve 23 extends about the shaft 13 coaxially therewith down to the lower end of the shaft 13. Further, a tube 24 is connected to the underside of the supporting device 15 and the upper end of the tube opens opposite the longitudinal centre of the reel 20 mounted on the supporting device 15 while the lower end of the tube 24 opens adjacent the outer periphery of the sleeve 23. The rope 21 is intended to be pulled via a bushing in the supporting device 15 down through the tube to the point adjacent the periphery of the sleeve 23 and farther axially downward to a winding head 25 in the lower end of the shaft 13 and the sleeve 23.

As shown in FIG. 2, the winding head 25 consists of a cylindrical portion 26 which is fixed by means of a neck portion 52 and a stop screw (not shown) in the lower end of the sleeve 23. The cylindrical portion 26 extends downward past the lower end of the fixed shaft 13 projecting from the sleeve 21 and has below said lower end a cylindrical space. The portion 26 which defines the cylindrical space, and the neck portion 52 have a lining 27 of plastics, preferably Nylon®. The lining has a smooth inner side. A recess 28 extends from the outer side of the portion 26 and opens at the inner side of the lining 27. A cylindrical means 29 is fixed with the aid of a screw (not shown) to the lower end of the shaft 13. The means 29 has axially, advancing grooves 53, as shown in FIG. 3, and is received in the lined cylindrical space of the portion 26 with easy running fit to the wall of the space. At the lower end the lining 27 has an enlarged cylindrical portion so that a gap 57 is formed between the lining and the periphery of the means 29, in which gap the rope 21 is receivable, while being slightly pinched between the lands of the means 29 and the lining 27. The rope running along the sleeve 23 is drawn in from the outer side of the sleeve to the gap 57 via the recess 28. Part of the periphery of the rope within the gap 57 will touch the means 29 at the lower end of the shaft 13 and upon rotation of the cylindrical portion 26 the rope will be drawn towards the downwardly facing outlet opening of the gap 57 and discharged from the winding head 25 in the form of a coil having a diameter that normally slightly exceeds that of the winding head.

FIG. 1 shows a container 31 into which the rope 21 is to be packed. The container 31 is cylindrical and has a likewise cylindrical tube 32 upstanding from the bottom, whereby an annular space is defined in the container 31. The radial extension of said annular space slightly exceeds the diameter of the winding head 25. The rope 21 is intended to be placed in said coils in said annular space by rotation of the winding head 25. To achieve this the container 31 must, however, be rotated about its axis, as will appear from FIG. 1, and at the same time be displaced vertically downwards.

To have the container 31 effect said movements a support means 30 is provided, which on its upper side has support and holder means 33 for retaining the container 31. A threaded shaft 34 is connected to the underside of the support means and extends coaxially with the container 31. The shaft 34 is rotatable with the aid of a pulley 35 via a central fastening 36 therein. The pulley 35 is rotated by means of a V-belt 37 and a drive pulley 38 engaging said V-belt. The pulley 35 with the fastening 36 is mounted in a holder means 39 which is connected to the frame 10 and at its underside has a bushing 41 with a hollow cross-piece provided with a threaded portion 42 engaging the threads of the shaft 34, which by means of a handle 43 can be moved into and out of engagement with the threads of the shaft 34. Upon rotation of the shaft 34 by means of the pulley 35 the shaft will also move axially because of its engagement with the threaded portion 42. The engagement between the shaft 34 and the central fastening 36 of the pulley 35 is a frictional engagement which does not prevent the shaft 34 from moving axially.

A disk 44 having a central opening of slightly greater diameter than that of the tube 32 and an opening for the winding head 25 is carried by arms 45, 46 of which the latter is pivotally connected to the frame 10 and rockable by means of an eccentric 54. The purpose of the disk 44 will appear from the following.

For rotation of the drive pulleys 18, 38 gearings 47, 48 are provided, which are driven by means of a shaft 49 in turn driven by a V-belt pulley 51 via a worm gearing 50. Instead of the gearings 47, 48 and 50 many other possibilities to drive the pulleys are conceivable.

The described machine is used in the following manner to pack a rope 21 into the container 31. First, the rope 21 is drawn via the tube 24, the outer side of the sleeve 23 and the recess 28 to the gap 57 in the winding head 25. Preferably, a sufficiently long rope length is withdrawn from the winding head 25 to permit being placed along the inner surface of the container up to the upper edge and folded about said edge, such that the lowermost end of the rope is accessible. Then a container 31 is placed on the support means 30 and fixed in correct position. By detaching the threaded piece 42 by means on the handle 43 the shaft 34 can be urged axially upward until the winding head 25 is adjacent the bottom of the container 31. Then the threaded piece 42 is again engaged with the threads of the shaft 34 by swinging of the handle 43. The machine is now ready for start.

When the machine is started the supporting device 15 is caused to rotate whereby the reel 20 is rotated about the shaft 13 as indicated at 20'. By this rotation the rope 21 drawn down to the winding head will be twisted or turn about its own axis, which generally is a prerequisite for its being discharged in a correct manner from the winding head. The portion 26 rotates because of its connection with the supporting device 15 via the sleeve 23 and the connecting means 22 at the same speed of rotation as the reel 20 and the rope is discharged via the gap 57 in a portion 26 in coils from the winding head 25, as indicated to the left in FIG. 1. At the same time the container 31 is rotated very slowly via the support means 30 and the shaft 34 so that the coils are arranged in a uniform layer in the container 31 about the central tube 32 thereof. When the container 31 has rotated a full revolution it has simultaneously moved a distance downwardly approximately corresponding to the rope thickness owing to the engagement of the threaded shaft 34 with the threaded piece 42, and a new layer of rope coils is placed on the layer already laid. The rope coils are placed below the disk 44 which has the task of pressing the laid layers together from above. If necessary, the disk 44 can be adapted to oscillate axially in that the eccentric 54 actuates the arm system 45, 46. When the winding head approaches the upper end of the container 31 the packing is interrupted and the container 31 can be removed after further lowering, if any, of the support means 30 by release of the threaded piece 42 and cutting of the rope 21.

With the aid of the machine according to the invention it is possible to pack a rope in the above-described manner in a fraction of the time required for manual packing of the rope. Besides, packing takes place in an extremely advantageous, safe manner and it has proved that the rope length which can be packed is considerably longer than that which can be packed in the same container by hand. The drawing shows a special container with a central tube, but it is obvious that applying the invention one can pack the rope also into other containers and for other purposes than that mentioned in the introduction.

I claim:

1. A method of packing a rope (21) into a container (31) in such a manner as to permit easy extraction of the rope therefrom, comprising the steps of providing a supply reel (20) of rope (21); providing a container (31) wherein rope withdrawn from said supply reel (20) is to be coiled; providing a winding head (25) having a fixed central piece (29) and tubular pulling means (26) disposed about said central piece (29) so as to define a gap (57) in which said rope (21) may be frictionally received, said pulling means (26) being rotatable about said central piece (29) to cause rope received in said gap (57) to move at least part of a turn about said central piece (29) and exit from a lower end of said gap (57) as a coil; positioning said winding head (25) relative to said container (31) so that said coil has a centre situated between the centre line and periphery of said container (31); connecting rope (21) from said supply reel (20) to said winding head (25); rotating said pulling means (26) about said central piece (29) to withdraw rope (21) from said supply reel (20) and coil the rope (21) within container (31); rotating said container (31) about its axis and simultaneously moving said container axially relative to the winding head (25); and rotating said rope (21) about its longitudinal axis on its way into the container (31).

2. A machine for packing a rope (21) into a container (31) in such a manner as to permit easy extraction of the rope therefrom, comprising a frame (10) with a shaft (13) fixed at its upper end and extending a predetermined distance vertically downward, a supporting device (15), means for rotatably mounting the supporting device (15) on the shaft (13), a rope reel (20), means for rotatably mounting the rope reel (20) on the supporting device (15), support means (30) for supporting the container (31) such that a centre line of the container (31) extends parallel to and is laterally spaced from the fixed shaft (13), whereby said fixed shaft projects into the container (31) with an axis of said fixed shaft situated in a space between the centre line and periphery of the container, a rotary winding head (25) on a free end of the fixed shaft (13) projecting into the container (31), said winding head having rotatable means (26) for withdrawing the rope (21) from the rope reel (20) and for coiling the rope with the coil centre situated between the centre line and periphery of the container, first rotation means (16-18) for rotating the reel supporting device (15) and said rotatable means (26) of the winding head (25), and second rotation means (34-42) for rotating the support means (30) with the container (31) and for simultaneously axially moving the support means (30) vertically downward.

3. A machine as claimed in claim 2, including a cylindrical sleeve (23) received over the vertical fixed shaft (13), said sleeve (23) having an upper end rigidly connected to the rope reel supporting device (15) for rotation with said supporting device and having a lower end cooperable with the winding head (25).

4. A machine as claimed in claim 3, wherein the winding head (25) comprises a tubular means (26) connected to said lower end of the sleeve (23) and defining a cylindrical space, and a substantially cylindrical abutment (29) mounted on the fixed shaft (13) within said cylindrical space and defining together with an inner wall surface of the tubular means (26) an annular gap (57) in which the rope (21) is receivable while being slightly pinched between said abutment (29) and said inner wall surface of the tubular means (26), said gap having a lower open end from which the rope, after having described at least part of a turn about the abutment, is dischargeable as a coil upon rotation of the tubular means (26) relative to the abutment (29).

5. A machine as claimed in claim 4, wherein the rope reel supporting device (15) has a tube means (24) for guiding the rope (21) from the reel (20) to the outer surface of the sleeve (23) and wherein said tubular means (26) has a recess (28) in communication between said gap (57) and said outer surface of the sleeve (23), the rope being introducible into the gap (57) via said recess (28).

6. A machine as claimed in claim 4, wherein the tubular means (26) has a lining (27) of plastics and the abutment (29) has axially advancing grooves (56) in its peripheral surface.

7. A machine as claimed in claim 2, wherein the support means (30) of the container (31) is fixed on a vertical threaded shaft (34) rotatable by means of a driven wheel (35) coupled to said threaded shaft, said threaded shaft being in threaded engagement with a threaded portion (42) connected to the frame (10), whereby rotation of the threaded shaft (34) by said drive wheel (35) causes said threaded shaft, and thus the support means (30) and the container (31), to move vertically downward, and wherein said machine further includes means (43) for swinging the threaded portion (42) into and out of engagement with the shaft (34).

8. A machine as claimed in claim 2, including a disk (44), means connected to the frame (10) for supporting said disk (44) within said container (31), said disk (44) having an opening through which the winding head (25) extends, and means (54) for oscillating said disk supporting means (45, 46) longitudinally of the container (31) to abut said disk (44) against and thereby pack the rope (21) coiled in the container (31).

9. A machine as claimed in claim 2, wherein the container (31) has a central axial sleeve (32) which defines an annular space in the container (31) to receive the rope coils.

* * * * *